United States Patent [19]

Hukuba et al.

[11] 3,977,038

[45] Aug. 31, 1976

[54] CONTROLLING APPARATUS FOR DRIVING GEAR IN SUCTION CLEANER

[75] Inventors: Hiroshi Hukuba, Nagareyama; Iwao Ikegami; Teruaki Yasuda, both of Tokyo, all of Japan

[73] Assignee: Hiroshi Hukuba, Nagareyama, Japan

[22] Filed: May 21, 1975

[21] Appl. No.: 579,491

[30] Foreign Application Priority Data

May 25, 1974 Japan ..... 49-58925

[52] U.S. Cl. ..... 15/339; 15/315; 15/323

[51] Int. Cl.[2] ..... A47L 9/28

[58] Field of Search ..... 15/315, 323, 347, 339, 15/352, 336, 327 F; 226/118, 181; 254/175 S; 318/280

[56] References Cited

UNITED STATES PATENTS

| | | | |
|---|---|---|---|
| 2,051,728 | 8/1936 | Manning | 15/315 X |
| 3,739,421 | 6/1973 | Fukuba | 15/319 |

FOREIGN PATENTS OR APPLICATIONS

| | | | |
|---|---|---|---|
| 1,235,380 | 5/1960 | France | 15/315 |

*Primary Examiner*—Christopher K. Moore
*Attorney, Agent, or Firm*—Woodhams, Blanchard and Flynn

[57] ABSTRACT

A controlling apparatus for the driving gear of a suction cleaner equipped with a container accommodating a suction fan together with a motor for actuating said fan, a suction hose, and a device for the paying-out and hauling-in of said suction hose together with a reversible motor for actuating said device, both of said motors being supposed to be controlled by means of controlling circuits to be actuated by a switch disposed near the fore end of said hose through a couple of lead wires buried in the hose, wherein said controlling circuits for these motors are respectively provided with three relays for actuating the respective motor and three switches for actuating said relays as incorporated therein, two of three circuits thus combined with said relay and actuating switch corresponding therewith are respectively provided with AC half-wave rectifiers having opposite polarities while the remaining one circuit is provided with contacts to be controlled by two relays included in said two circuits.

4 Claims, 7 Drawing Figures

CONTROLLING APPARATUS FOR DRIVING GEAR IN SUCTION CLEANER

BACKGROUND OF THE INVENTION

The present invention relates to a controlling apparatus for the driving gear of suction cleaner. The present applicant has previously filed an application for patent as U.S. Ser. No. 461738 on a suction cleaner which is devised such that the interior of the container is divided into chambers by partitions, said chambers contain a suction fan, a filter member, a dust-receiving box and a suction hose respectively, the rear end of said suction hose is rotatably fixed to a hole provided on a partition while the fore end of the hose is led to the outside of the wall of the container through a hole provided thereon, a device for paying out and hauling in the hose is equipped in the inside of said hole, lead wires are installed in the hose along the whole length thereof, the fore end of said lead wires is connected with a switch installed on the hose while the rear end of same is connected with a movable contact member, said movable contact member is to come in touch with a fixed contact member installed on the partition, and said fixed contact member is connected with the controlling circuits of the driving power source for the suction fan as well as the paying-out/hauling-in device.

In the case of the suction cleaner in said previous application, the controlling circuits are so constructed as to perform regular operations at all times, to wit, paying-out of the hose to be followed by stopping thereof, driving of the suction fan to be followed by stopping thereof, and hauling-in of the hose to be followed by stopping thereof, and the switches used therein are ones capable of functioning for these purposes, so that it has been difficult to return them to the state of actuating another operation in the course of one operation.

Accordingly, it is attended with troubles such as, for instance, in the case where it is intended to resume the work of paying out the hose after once stopping it in the midst of said work, the switch must be operated to the last in regular sequence as above thereby to bring it again to a position for effecting the paying-out of the hose. The same trouble as above has been involved in the operation of the suction fan and the hauling-in of the hose.

As a result, the previous suction cleaner has been defective in that the frequency of the operation of switch increases uselessly, the cleaner cannot be efficiently operated, the operation per se is complicated, the switch is apt to go out of order, and so on.

SUMMARY OF THE INVENTION

One object of the present invention is to provide a controlling apparatus for the driving gear of suction cleaner, which overcomes the foregoing defects of the conventional suction cleaners, is easy to operate, and renders efficient operation of cleaners.

Another object of the present invention is to provide a controlling apparatus, wherein a motor for actuating the suction fan and a reversible motor for the paying-out and hauling-in of the suction hose are devised to be actuated by alternating current, the controlling circuits for each motor form three series circuits including three relays and three switches corresponding with these relays and consisting of the combination of each relay and switch, and two of these three circuits are respectively provided with AC half-wave rectifiers having opposite polarities while the remaining one circuit is provided with contacts to be controlled by two relays included in said two circuits, whereby each motion of the respective motors can be actuated by selectively operating desired one of three different switches and accordingly the operation of said controlling apparatus is rendered very easy and efficient compared with the conventional controlling apparatuses.

A further object of the present invention is to provide a controlling apparatus, wherein an amplifying circuit including silicon controlled rectifier is provided in the controlling circuit thereby to prevent the lowing of efficiency of the controlling circuit pursuant to the voltage drop in the lead wires buried in the suction hose with the elongation of said hose, to control each motor exactly even when the hose is lengthened, and to render it possible to extend the range of cleaning by lengthening the hose.

A still further object of the present invention is to provide a controlling apparatus, wherein each switch for actuating each relay is composed of contacts disposed at almost equal intervals, to wit, at angular intervals of 120°, on a circular seat installed near the fore end of the hose and a contact piece whose base is pivotally supported in the center of said contacts and whose tip comes in touch with said contacts as it rotates, thereby rendering it possible to perform the switchover of the motion of each motor easily by turning the angle of the contact piece of switch by 120° to the adjoining contact.

Still another object of the present invention is to provide a controlling apparatus, wherein the tip of the rotating contact piece of the switch is bifurcated so as to make the respective tip of the bifurcated contact piece touch with two poles corresponding therewith, thereby ensuring exact and smooth contact between them.

DETAILED DESCRIPTION OF THE INVENTION

Figure 1:
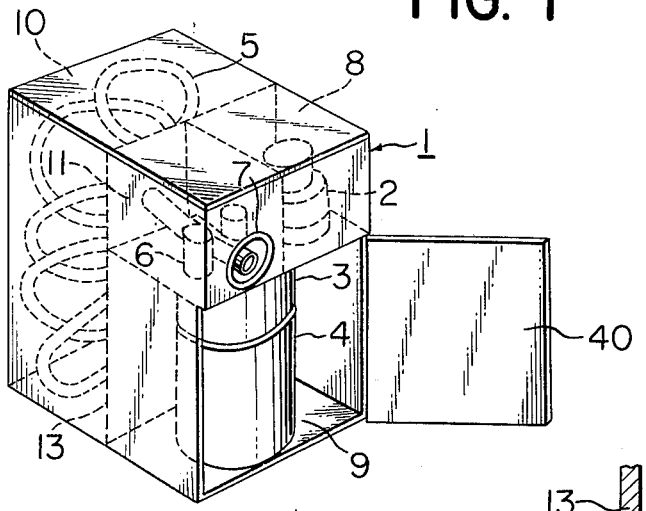
FIG. 1 is a perspective view — as a whole — of a suction cleaner provided with the controlling apparatus for the driving gear according to the present invention.

Referring to FIG. 1, the reference numeral 1 denotes the container whose interior is divided into the first chamber 8, second chamber 9, third chamber 10 and fourth chamber 11.

In the first chamber 8 is installed the suction fan 2, and in the second chamber 9 are installed the cyclone drum 3 connected with the inlet part of the suction fan 2 and the dust-receiving box 4 incorporated with the lower part of said cyclone drum 3, the opening of said chamber 9 being provided with the door 40.

In the third chamber 10 is accommodated the hose 5 of about 10 to 15 m long at liberty, and the fore end of said hose 5 penetrates the partition 13 and is led to the outside of the container 1 through the fourth chamber 11. In the fourth chamber 11 are installed a pair of rollers 6 and 6' which hold the hose 5 by two sides thereof, rotate in opposite directions and are interlocked, and either one of said rollers 6 and 6' is devised to rotate selectively in the normal and reverse directions by means of the reversible motor 34 installed inside the container 1 as will be described later on.

Figure 2:
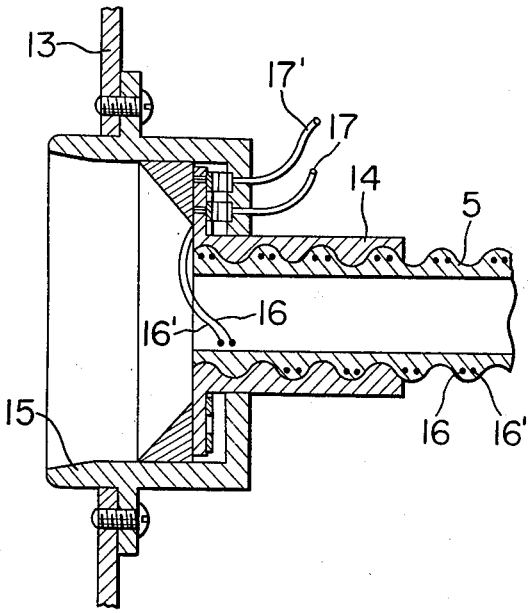
FIG. 2 is a cross-sectional view of the setup for fixing the suction hose on the partition within the container of the apparatus shown in FIG. 1.

The hose 5 is, as shown in FIG. 2, composed of a couple of helical lead wires 16 and 16' running parallel with each other and having their outside surrounded with a flexible film, and the rear end thereof is rotatably connected with the partition 13 by means of the supporting member 14 and the receiving member 15. Detailed description of the construction of this portion is omitted herein as it has already been disclosed in U.S. Ser. No. 461,738. One thing to be noted herein is that the lead wires 16 and 16' are connected with the lead wires 17 and 17' in this portion.

The receiving member 15 and the cyclone drum 3 are interconnected by means of a pipe not shown in the drawing.

Figure 3:
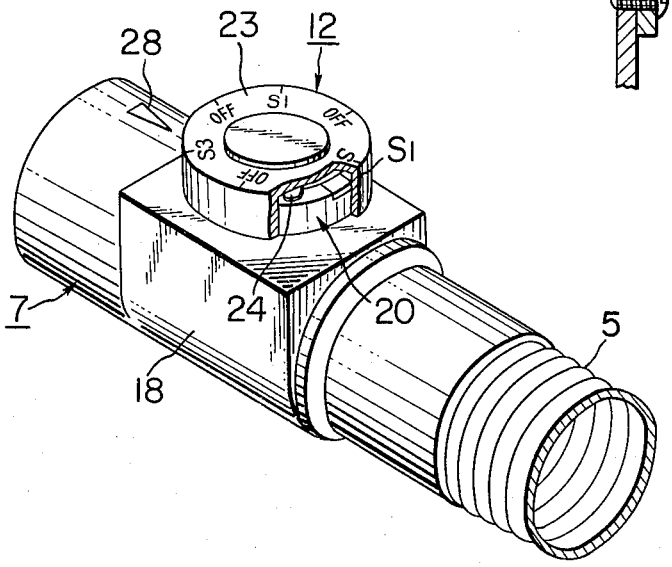
FIG. 3 is a perspective view of the coupling portion of the hose shown in FIG. 1, as partially cut off.

On the fore end of the hose 5 is installed the coupling 7 as shown in FIG. 3, and to the opposite side of said coupling 7 is detachably connected a suction tip not shown in the drawing.

Figure 4:
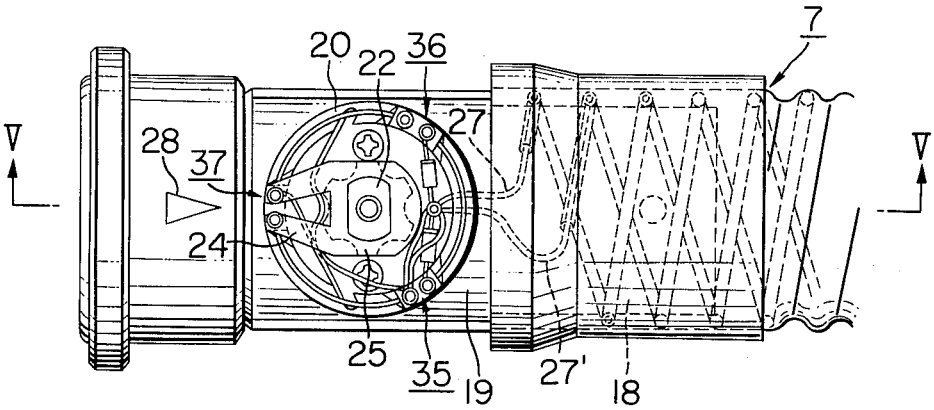
FIG. 4 is a plane figure of the switch of the same coupling portion as in FIG. 3, wherein the interior of said switch is shown by removing the knob.
Figure 5:
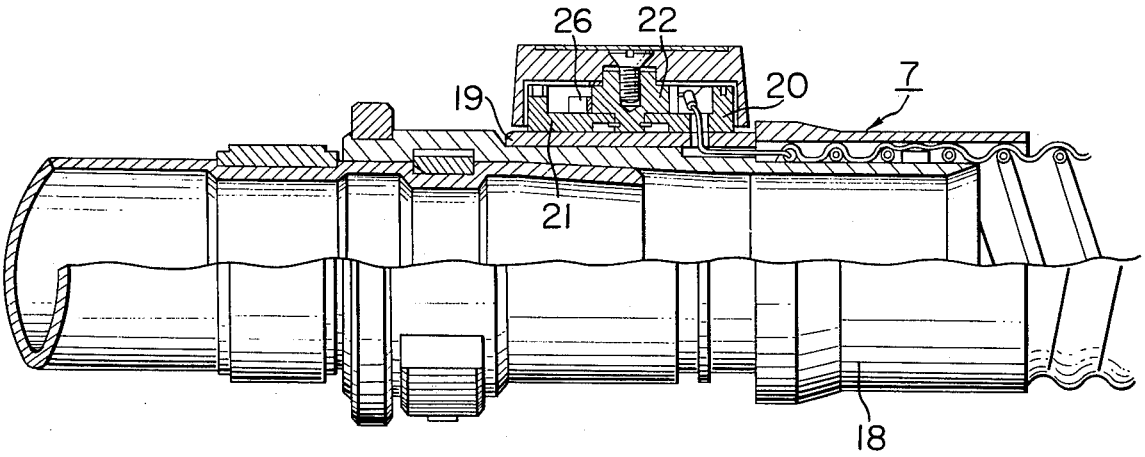
FIG. 5 is a cross-sectional view of the upper half of the same switch as in FIG. 4, as taken along the line A—A in said drawing.

The coupling 7 is provided with the switch 12 whose particulars are as shown in FIGS. 4 and 5. In FIGS. 4 and 5, 18 denotes the tubular coupling base. On the surface of a portion of this coupling base 18 is installed the rubber seat 19 with flat surface, and on said flat surface of the seat 19 is installed the supporting member 21 with the circular wall 20.

In about the center of this supporting member 21 is rotatably installed the rotating member 22, and in the surroundings of said rotating member 22 are formed six recesses 25. The recess 25 is engaged with the top of the spring 26, the tips of both legs of said spring 26 are fixed in the slot provided on the circular wall 20, and by dint of the pressure of this spring 26, the rotating member 22 is supposed to be held in a fixed position.

On the top face of the rotating member 22 is installed the knob 23 having a skirt portion to cover the circular wall 20. In between the bottom face of the knob 23 and the top face of the rotating member 22 is held the contact piece 24 whose fore end is bifurcated and extends to the top face of the circular wall 20.

The coupling base 18 is provided with the lead wires 27 and 27' which are connected with the lead wires 16 and 16' of the hose 5 and extend into the internal space of the knob 23. These lead wires 27 and 27' are equipped with the diodes D1 and D2 as the half-wave rectifier and further extend to the top face of the circular wall 20 to be connected with the contacts 35, 36 and 37 disposed thereon at almost equal intervals (120°). These contacts 35, 36 and 37 together with the contact piece 24 form the switches S1, S2 and S3 of the controlling circuits to be described later on, and by the engagement and disengagement between the contact piece 24 to rotate with the rotation of the knob 23 and the contacts 35, 36 and 37, the switches S1, S2 and S3 are opened and closed. The top face of the knob 23 carries literal indications to signify the opening and closing of said switches, and the surface of the coupling base 18 carries the signal 28 to correspond with said literal indications.

Two varieties of embodiment of the controlling circuit and driving circuit for cleaner as discussed above are illustrated in FIG. 6 and FIG. 7. These circuits are usually disposed in the proper place within the container 1; in the drawings, 31 and 31' denote different embodiments of the controlling circuit, and 32 denotes an embodiment of the driving circuit, that is, the driving circuits applied herein are identical.

Figure 6:
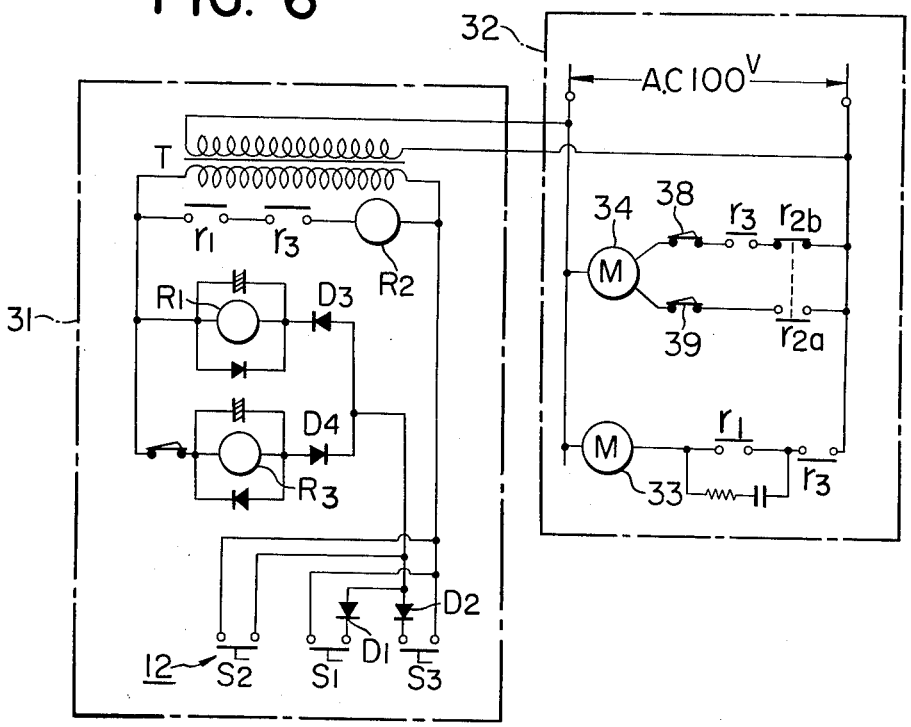
FIGS. 6 and 7 are diagrammatic representations of two embodiments of the controlling circuit and driving circuit in the controlling apparatus for driving gear according to the present invention.
Figure 7:
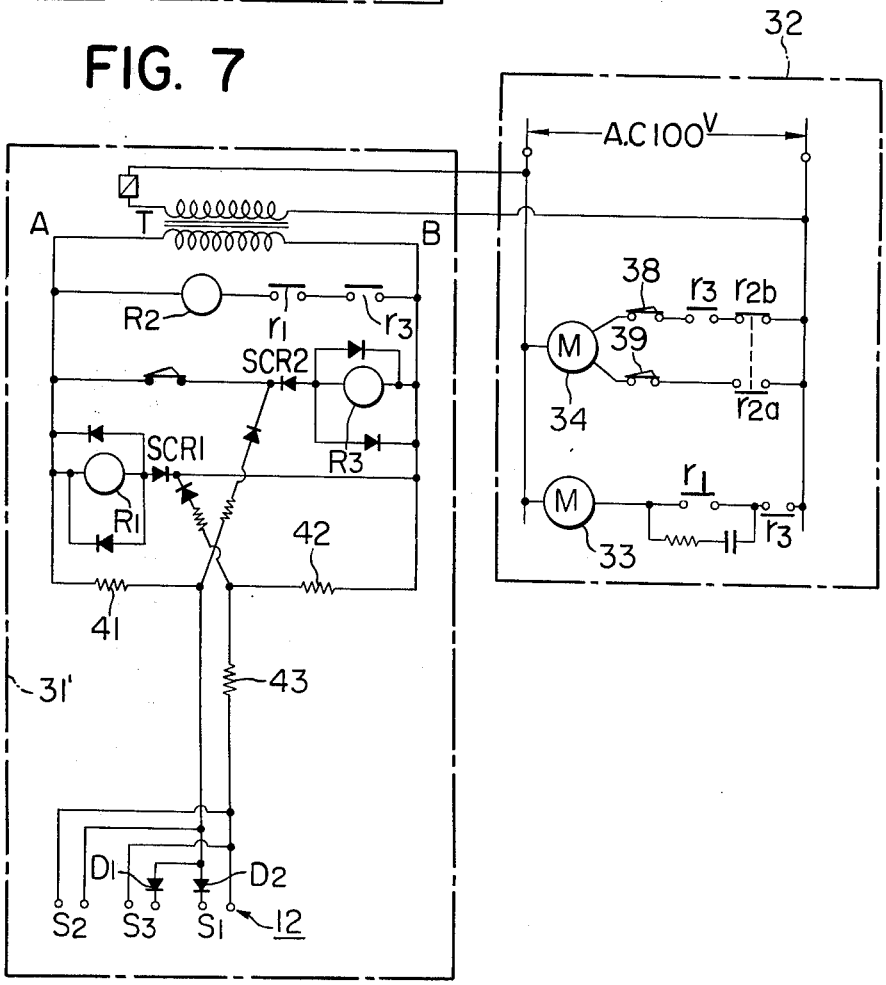

In FIGS. 6 and 7, 33 denotes the motor for the suction fan, and 34 denotes the reversible motor for the paying-out and hauling-in of the hose 5. As the electric power, 100-V alternating current supplied from the commercial alternating current source is to be employed.

In the circuits 31 and 32 of FIG. 6, S1, S2 and S3 denote the switches for actuating the relays R1, R2 and R3, respectively. The relays R1 and R2 are for the purpose of actuating the motor 33 for the suction fan, and the relays R2 and R3 are to serve for the normal and reverse rotation of the reversible motor 34. *r1, r2a, r2b* and *r3* denote the contacts to be engaged and disengaged by means of the relays R1, R2 and R3 respectively.

Hereunder will be explained how to operate the above described apparatus.

At the time of using the apparatus, the hose 5 accommodated in the container 1 as shown in FIG. 1 is to be paid out up to a desired place. For this purpose, the knob 23 of the switch 12 is manipulated so as to make the literal indication 'S2' on the surface thereof face the signal 28, whereby the switch S2 is closed and alternating current is directly applied to the controlling circuit 31, the relay R2 is actuated to close the contact *r2a* of the driving circuit 32 and rotate the motor 34, and the rollers 6 and 6' are rotated in the normal direction thereby to pay out the hose 5.

Upon thus paying out the hose 5 to a desired place, by either opening the switch S2 by means of the switch 12 or opening the microswitch 39 by means of a member attached to the hose 5 not shown in the drawing, the rotation of the motor 34 is stopped.

Next, on the occasion of hauling in the hose 5 paid out as above, the switch S3 is closed. At this, direct current resulting from the half-wave rectification by the diode D2 in the controlling circuit 31 flows toward the diodes D3 and D4, but this is an inverse voltage for the diode D3 so that the relay R1 is not actuated and only the relay R3 is actuated, the contact *r3* in the driving circuit 32 is closed to reverse the rotation of the motor 34 and haul the hose 5 in the container 1. When the hauling-in of the hose 5 is over, by either opening the switch S3 by means of the switch 12 or opening the microswitch 38 by means of a member attached to the hose 5 not shown in the drawing, the rotation of the motor 34 is stopped.

Particulars of the operation mechanism of the foregoing microswitches 38 and 39 have been disclosed in U.S. Ser. No. 456,461.

On the occasion of actuating the suction fan 2 independently of the paying-out and hauling-in of the hose 5, the switch S1 is closed. At this, direct current resulting from half-wave rectification by the diode D1 in the controlling circuit 31 flows toward the diodes D3 and D4, but this is an inverse voltage for the diode D4 so that only the relay R1 is actuated, the contact *r*1 in the driving circuit 32 is closed to rotate the motor 33 and the suction fan 2 is actuated.

With the actuation of the suction fan 2, dust-air current is sucked in through a suction pipe not shown in the drawing which is attached to the coupling 7 provided on the fore end of the hose 5, and is sent in the cyclone drum 3 wherein the dust is separated to fall in the dust-receiving box 4 while the purified air is released to the outside of the container 1 through an exhaust part not shown in the drawing. The dust accumulated in the dust-receiving box 4 is taken out of said box for disposal by opening the door 40.

In FIG. 7 is shown the controlling circuit 31' of such a mode as combining an amplifying circuit with the controlling circuit shown in FIG. 6. Two lead wires 16 and 16' are to serve for keeping the hose 5 is shape concurrently, so that they are usually made of steel wire. However, as they are helically buried in the hose 5 having a length of as much as 10 – 15 m, there inevitably occurs voltage drop between the switch 12 and the controlling circuit 31'. Therefore, in the present embodiment, in order to prevent the lowering of performance even in the case of voltage drop as above, an amplifying circuit is supplemented thereto. The difference between the embodiment in FIG. 7 and the embodiment in FIG. 6 lies in that, the former employs the silicon-controlled rectifiers SCR1 and SCR3 instead of the diodes D3 and D4, and these rectifiers are respectively combined with a gate circuit.

In this controlling circuit 31', when the switch S2 is closed, the rectifiers SCR1 and SCR2 are alternately triggered with cycle of frequency thereby to actuate the relays R1 and R3, close the contacts *r*1 and *r*3, actuate the relay R2, close the contact *r*2*a* in the driving circuit 32 to rotate the motor 34, and rotate the rollers 6 and 6' in the normal direction to pay out the hose 5.

Next, the switch S3 is closed. When the potential at the point B is positive on this occasion, the rectifier SCR1 has reversed polarity relative to this potential and therefore is triggered, but with the voltage drop of the resistance 41, the rectifier SCR2 is triggered to have positive polarity, direct current resulting from half-wave rectification flows to actuate the relay R3, and the contact *r*3 in the driving circuit 32 is closed to rotate the motor 34 reversely, whereby the hose 5 is hauled in.

When the switch S1 is also closed, and the potential at the point A is positive on this occasion, the rectifier SCR2 has reversed polarity relative to this potential and therefore is not triggered, but with the voltage drop of the resistance 42, the rectifier SCR1 is triggered to have positive polarity, direct current resulting from half-wave rectification flows to actuate the relay R1, and the contact *r*1 in the driving circuit 32 is closed to rotate the motor 33, whereby the suction fan 2 is actuated.

Although particular preferred embodiments of the invention have been disclosed hereinabove for the purpose of illustration, it will be understood that variations or modifications thereof which lie within the scope of the invention as defined by the appended claims are fully comtemplated.

What is claimed is:

1. A controlling apparatus for the driving gear of a suction cleaner equipped with a container accommodating a suction fan together with a motor for said suction fan, a suction hose, and a device for paying-out and hauling-in of said suction hose together with a reversible motor for said device, both of said motors being supposed to be controlled by means of controlling circuits to be actuated by a switch disposed near the fore end of said hose through a couple of lead wires buried in the hose, wherein said two motors are to be actuated by alternating current, said controlling circuits (31, 31') for these motors are respectively provided with a relay (R1) for actuating the motor (33), relays (R2 and R3) for normal and reverse rotations of the motor (34) and three switches (S1, S2 and S3) constituting the foregoing switch for actuating these relays (R1, R2 and R3), optional two circuits among the first circuit comprising said relay (R1) and switch (S1), second circuit comprising said relay (R2) and switch (S2) and third circuit comprising said relay (R3) and switch (S3) are respectively provided with AC half-wave rectifiers having opposite polarities while the remaining one circuit is provided with contacts to be controlled by two relays included in said two circuits provided with said rectifiers.

2. A controlling apparatus for driving gear according to claim 1, wherein an amplifying circuit comprising a silicon-controlled rectifier is additionally provided.

3. A controlling apparatus for driving gear according to claim 1, wherein said switches (S1, S2 and S3) consist of contacts (35, 36 and 37) disposed at practically equal intervals on a circular seat installed near the fore end of said suction hose (5) and a contact piece (24) whose base end is pivotally supported in the center of said contacts and whose tip is supposed to come in touch with said contacts alternately as it rotates.

4. A controlling apparatus for driving gear according to claim 3, wherein the tip of said contact piece (24) to come in touch with two poles of said contacts (35, 36 and 37) is bifurcated.

* * * * *